US007811183B1

(12) United States Patent
Ohle

(10) Patent No.: US 7,811,183 B1
(45) Date of Patent: Oct. 12, 2010

(54) BALL KICKING-TRAINING APPARATUS

(76) Inventor: Robert D. Ohle, 537 S. Flower St., Lakewood, CO (US) 80226

( * ) Notice: Subject to any disclaimer, the term of this patent is extended or adjusted under 35 U.S.C. 154(b) by 0 days.

(21) Appl. No.: 12/500,773

(22) Filed: Jul. 10, 2009

(51) Int. Cl.
*A63B 69/00* (2006.01)

(52) U.S. Cl. ..... 473/429; 473/446; 473/420

(58) Field of Classification Search ..... 473/420, 473/423, 427, 429, 446; 403/56, 61, 76, 403/90, 115, 129, 131, 143, 165; 464/152; 248/56; 384/211
See application file for complete search history.

(56) References Cited

U.S. PATENT DOCUMENTS

| | | | | | |
|---|---|---|---|---|---|
| 169,383 | A | * | 11/1875 | Starr | 403/90 |
| 1,169,901 | A | * | 2/1916 | Wittemann et al. | 464/152 |
| 2,633,320 | A | * | 3/1953 | Salmi | 248/123.2 |
| 3,794,320 | A | * | 2/1974 | Salmont | 473/429 |
| 4,042,237 | A | * | 8/1977 | Moraru | 473/429 |
| 4,516,769 | A | * | 5/1985 | Kopp | 473/423 |
| 4,561,661 | A | | 12/1985 | Walker et al. | |
| 4,576,379 | A | | 3/1986 | Juhasz | |
| 4,616,834 | A | | 10/1986 | Davis | |
| 4,720,095 | A | | 1/1988 | Sowards | |
| 5,037,113 | A | | 8/1991 | Sowards | |
| 5,228,684 | A | * | 7/1993 | Levatino | 473/457 |
| 5,435,572 | A | | 7/1995 | Covel | |
| 5,472,186 | A | * | 12/1995 | Paulsen | 473/429 |
| 5,553,848 | A | * | 9/1996 | Amron | 473/416 |
| 5,605,326 | A | * | 2/1997 | Spear, Jr. | 473/422 |
| 5,788,589 | A | * | 8/1998 | Koo et al. | 473/429 |
| 5,803,642 | A | * | 9/1998 | Sassmannshausen | 403/90 |
| 5,836,836 | A | * | 11/1998 | Grimes | 473/427 |
| 5,957,788 | A | * | 9/1999 | Eze | 473/422 |
| 5,957,789 | A | * | 9/1999 | Ainscough et al. | 473/423 |
| 6,475,108 | B1 | | 11/2002 | Sarenana, Sr. et al. | |
| 2008/0280702 | A1 | * | 11/2008 | Ohle | 473/423 |
| 2009/0286630 | A1 | * | 11/2009 | Aguirre | 473/420 |

* cited by examiner

*Primary Examiner*—Mark S Graham
(74) *Attorney, Agent, or Firm*—Dorr, Carson & Birney, P.C.

(57) ABSTRACT

A ball kicking-training apparatus has a base which vertically supports a post having a rotatable axle whose top end is provided with a ball and socket device. The ball component of the ball and socket device is attached to an arm whose opposite end is attached to the ball to be kicked by the user of the apparatus.

23 Claims, 8 Drawing Sheets

BALL KICKING-TRAINING APPARATUS

BACKGROUND OF THE INVENTION

1. Field of the Invention

This invention is generally concerned with training a person to kick a ball (such as a soccer ball or the like) through repeated placement of the ball in a prescribed region.

2. Discussion of the Background

Ball kicking-training apparatus are well known. For example, U.S. Pat. No. 4,616,834 teaches a ball-kicking training apparatus having a pivot post extending vertically out of a base. The pivot post rotatably supports an arm to which a ball to be kicked is attached. The ball to be kicked is mounted to the arm in such a manner that the ball rolls as it passes over the surface (ground, floor, etc.) with which it is in contact.

U.S. Pat. No. 6,475,108 B1 teaches a soccer kicking training device that includes a base with a stationary base connector, horizontal and vertical members, two ball holders, a height adjustment device, and a ball. The base is supported in a horizontal plane through means of weighted material in the base. The stationary base connector is attached to the base. The vertical member and horizontal member slide freely inside the stationary base connector. The device further comprises a top and side ball holder by means of which a ball can be mounted and/or attached to the device.

U.S. Pat. No. 5,435,572 teaches a ball kick-training device that is provided with a base having predesignated right and left support foot placement positions. The ball is attached to a shock adsorbing mechanism. The support foot placements are located in such a manner as to require the kicker to assume proper foot and body positions relative to the ball. The ball is raised to allow the kicker to practice kicking the ball with the instep of the foot. The shock absorbing mechanism absorbs the force of the kick and returns the ball to its initial position relative to the support foot placements so the practice process may be rapidly and consistently repeated.

U.S. Pat. No. 4,720,095 teaches a soccer training and practice device comprising a ball-like target mounted to an anchor member for engaging with the ground. The anchor member is in effect a helical coil that can be screwed into the ground. The ball-like target is mounted to the anchor member so that, when the anchor member is properly affixed to the ground, the ball will be in a position where it can be readily kicked.

U.S. Pat. No. 4,576,379 discloses an apparatus which enables an individual to practice the game of soccer by himself/herself without assistance from others. The apparatus enables a person to kick a soccer ball and have the ball automatically returned for frequent re-kicks. In addition, upon the return kicks, the ball will be traveling at some speed that simulates the travel of a ball during a soccer game. This invention also provides an apparatus which enables a person to hit the soccer ball with another part of his body, such as his head, and also have the ball automatically returned.

U.S. Pat. No. 5,037,113 teaches a soccer training device that includes a transportable pedestal and a soccer ball connected to the pedestal by a coil spring. The device is especially useful for practicing dribbling.

U.S. Pat. No. 4,561,661 teaches a soccer training device for use of both the head and the feet. It consists of three major parts, i.e., a base support structure, a fiberglass rod and a ball. The base support structure is similar to parasol stands. It possesses a mechanism for continuous height adjustment of the ball and the fiberglass rod. The rod is attached to the device by means of a swing element. The ball is attached to a revolving bearing at the tip of the fiberglass rod. The fiberglass rod and the swing element serve to store potential energy for the return flight of the ball. The ball is set into motion by the head or the foot of a player, and swings back and forth in an arc section of circular radius.

Applicant is of the opinion that improvements in ball kicking-training can be obtained by an apparatus that places the ball in a prescribed region—as opposed to a prescribed spot.

SUMMARY OF THE INVENTION

The ball kicking-training apparatus of this patent disclosure can be employed indoors as well as outdoors. It is especially useful in providing ball kicking training for young children desiring to perfect their ball kicking skills for the game of soccer. This ball kicking training is enhanced by the fact that this apparatus brings the ball to a prescribed general region rather than to a prescribed spot. This circumstance gives the user training in "anticipating" the general location of the returned ball rather than having that location strictly defined by the mechanical operation of the apparatus. Thus, this regional approach to placing the ball better simulates the circumstances that are usually encountered in the game of soccer.

Be that as it may, Applicant's apparatus comprises a mounting base that supports a vertically mounted post. The post (and a cavity in the base that holds said post) may be of any suitable cross sectional geometry, e.g., round, square, rectangular, etc. With all such geometries, however, the post should fit snuggly into the cavity in order to vertically orient said post. The post contains a rotatably mounted axle whose top end is affixed to a socket. The axle may, for example, be rotatable by virtue of the fact that it is mounted between a top roller bearing and a bottom roller bearing. The socket houses a ball component such that said ball component is free to rotate at various angles in the socket in the manner of a ball and socket joint. The ball component of the ball and socket joint is affixed to an arm whose other end is attached to the ball to be kicked as part of a kicking practice activity.

The arm is affixed to the ball component of the ball and socket joint by virtue of the fact that the arm passes through a hole in said ball component of the ball and socket joint. In one embodiment of this invention, the arm is compression fitted into the hole in the ball component of the ball and socket joint. Glue also may be used to affix the arm to the ball component of the ball and socket joint. The arm may extend through and project beyond the hole in the ball component of the ball and socket joint.

In another embodiment of this invention, the inner end of the arm is threaded in order to receive a forward threaded nut and a rearward threaded nut. The forward threaded nut is threaded on to the threaded inner end of the arm and subsequently threaded into abutment with a forward side of the ball and socket joint. The rearward threaded nut is then threaded on to the threaded inner end of the arm. It is threaded into abutment with a rearward side of the ball and socket joint. Thus, the inner end of the arm is affixed to the ball component of the ball and socket joint by virtue of being abutted between the forward threaded nut and the rearward threaded nut.

In both of the above described embodiments, the socket component of the ball and socket joint is mounted on an axle that is rotatably mounted in the vertically mounted post. Consequently, when the user kicks the kicking ball laterally, the arm will rotate with the axle to which the arm is ultimately affixed by reason of its attachment to the ball and socket joint.

The ball to be kicked by the user of the apparatus is attached to the outer end of the arm. Various methods for mounting a ball to an arm for the purpose of practicing kicking the ball are found in the prior art references previously noted in this patent disclosure and these references are incorporated herein by reference. However, one particularly effective device for attaching the ball to be kicked by the user of the present apparatus is to provide the outer end of the arm with a flexible cup that is capable of being forced into a hole in the ball to be kicked such that the flexible cup serves as a "hook" that prevents the arm from being withdrawn from the hole in the ball to be kicked. The cup and outer end of the ball to be kicked can also be coated with glue that, upon drying, further serves to affix the ball to be kicked to the outer end of the arm. The outside surface of the kicking ball can also be provided with a second cup that is affixed to the kicking ball's exterior surface. Here again, the cup and exterior surface of the kicking ball just under the cup can be supplied with glue that, upon drying, serves to further affix the second cup to the outside surface of the ball.

The apparatus of this patent disclosure can be provided with certain additional components. For example, a counterweight arm can be used to deal with the fact that the ball to be kicked is attached to an arm that will normally be from about 3 to 4 feet in length. Thus, the weight of the ball to be kicked creates a lever arm effect on the ball component of the ball and socket joint. The counterweight arm serves to balance the leverage created by the arm and ball. Moreover, the counterweight arm can be further provided with a fitting adapted to mounting a second ball to the counterweight arm. Such a second ball will also serve as a counterweight to the ball mounted on the arm. The length of the counterweight arm can be less than the length of the arm that supports the ball to be kicked. Such a second ball can be used with either embodiment of this invention. The second ball can be the same size as of the ball to be kicked or it can be sized differently from the first ball.

DETAILED DESCRIPTION OF THE INVENTION

Figure 1:
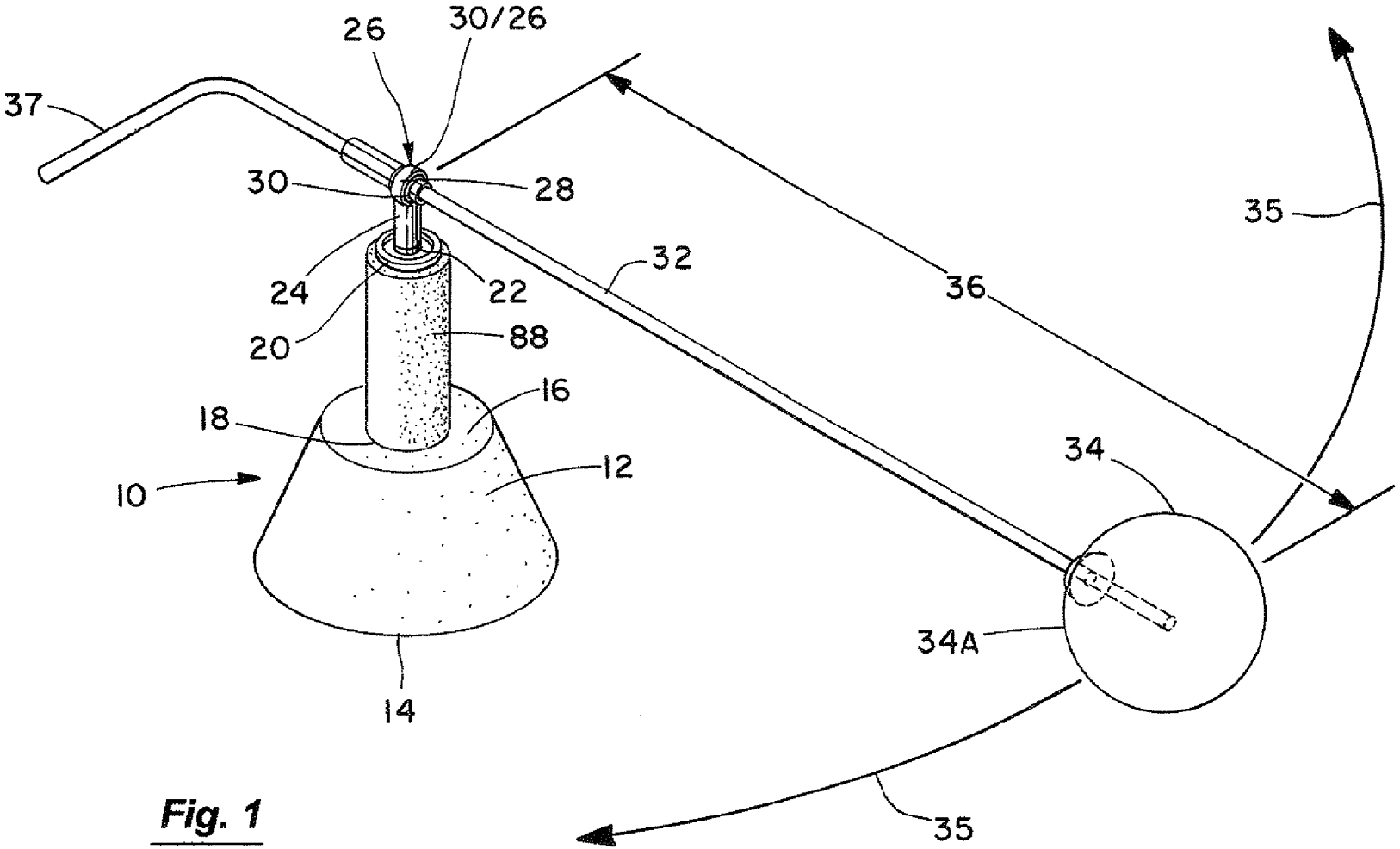
FIG. 1 is a perspective view of a ball kicking-training apparatus made according one embodiment of the present invention.

The ball kicking-training apparatus 10 depicted in FIG. 1 has a relatively heavy (e.g., weighing from about 1 pound to about 50 pounds) base 12 having a flat bottom 14. The base 12 may be a solid or it may contain a hollow space (not shown) into which a weight-imparting material such as water or sand may be placed in order to provide the desired weight—and therefore stability—to said base 12. The base 12 may be made of a plastic material such as hard rubber and/or vinyl (and especially those hard rubbers made from recycled automobile tires). Such a base 12 may, for example, have the truncated cone configuration depicted in FIG. 1. It could also have a square, rectangular, ellipsoidal, etc. configuration.

The top 16 of the base 12 has a cylindrical cavity 18 for receiving a post 20 (see FIG. 7) so that the base 12 holds said post 20 in a vertical orientation. The post 20, in turn, has a center hole 22 for receiving and rotatably mounting an axle 24. For example, the axle 24 may be rotatable by virtue of being mounted in a top roller bearing and bottom roller bearing in the manner depicted in FIG. 7. In any case, top of the axle 24 is affixed to a socket device 26. This socket device 26 has a housing 28 that rotatably mounts a ball component 30. The resulting ball and socket device 30/26 is akin to a synovial joint, such as a human hip joint, wherein a spherical knob of a bone fits into a cavity or socket of another bone so that some degree of rotary motion is possible around an indefinite number of axes having one common center. Many analogues to such synovial joints are found throughout the mechanical arts (e.g., control arms, steering knuckles, throttle linkages, etc.). The ball and socket joint 30/26 used by Applicant is also commonly referred to as a rod end bearing. Be that as it may, the opposite end of the arm 32 whose inner end is mounted to the ball component 30 of the ball and socket joint 30/26 is attached to a ball 34 to be kicked by the user of the apparatus 10. This ball 34 is held above ground level by certain mechanical actions of the ball and socket device 30/26 hereinafter more fully explained.

For example, vertical support of the ball 34 to be kicked is provided by the arm 32 whose motion is limited by the ball's range of motion as hereinafter more fully described in the respective discussions of FIGS. 2, 3 and 4. Again, since the socket 26 of the ball and socket device 30/26 is rigidly affixed to the axle 24 (which is free to rotate in the center hole 22 of the post 20), the kicking ball 34 is free to rotate a full 360° around the axle 24 in the post 20 as suggested by the two headed arrow 35 depicting the kicking ball's travel radius. In effect, the length 36 of the arm 32 defines the radius of the 360° circle about which the kicking ball 34 may travel. The other end of the ball component 30 of the ball and socket joint 30/26 may also be attached to a counterweight-imparting portion 37 of the arm 32. The counterweight-imparting portion 37 of the arm 32 can be bent as shown in FIG. 1 or be straight. The other end of the counterweight arm 37 can also be attached to a second ball 38 (such as the one depicted in phantom lines in FIG. 2).

The kicking ball's outer surface 34A is made of a compliant material (e.g., leather, vinyl plastic, a polymeric foam and the like). The ball 34 itself may be filled with air or it may be a solid. In one embodiment of this invention, a solid ball's inner regions are filled with a resilient material such as a polyurethane foam material. Indeed, the entire ball can be made of such a material. The ball 34 also may have a radius (e.g., about 3 to 4 inches) that is the same as (or smaller or larger) than the radius of a regulation sized 3, 4 or 5 soccer ball. Such relatively smaller, solid foam balls are particularly well suited for use by younger children (e.g., ages 4-10).

Figure 2:
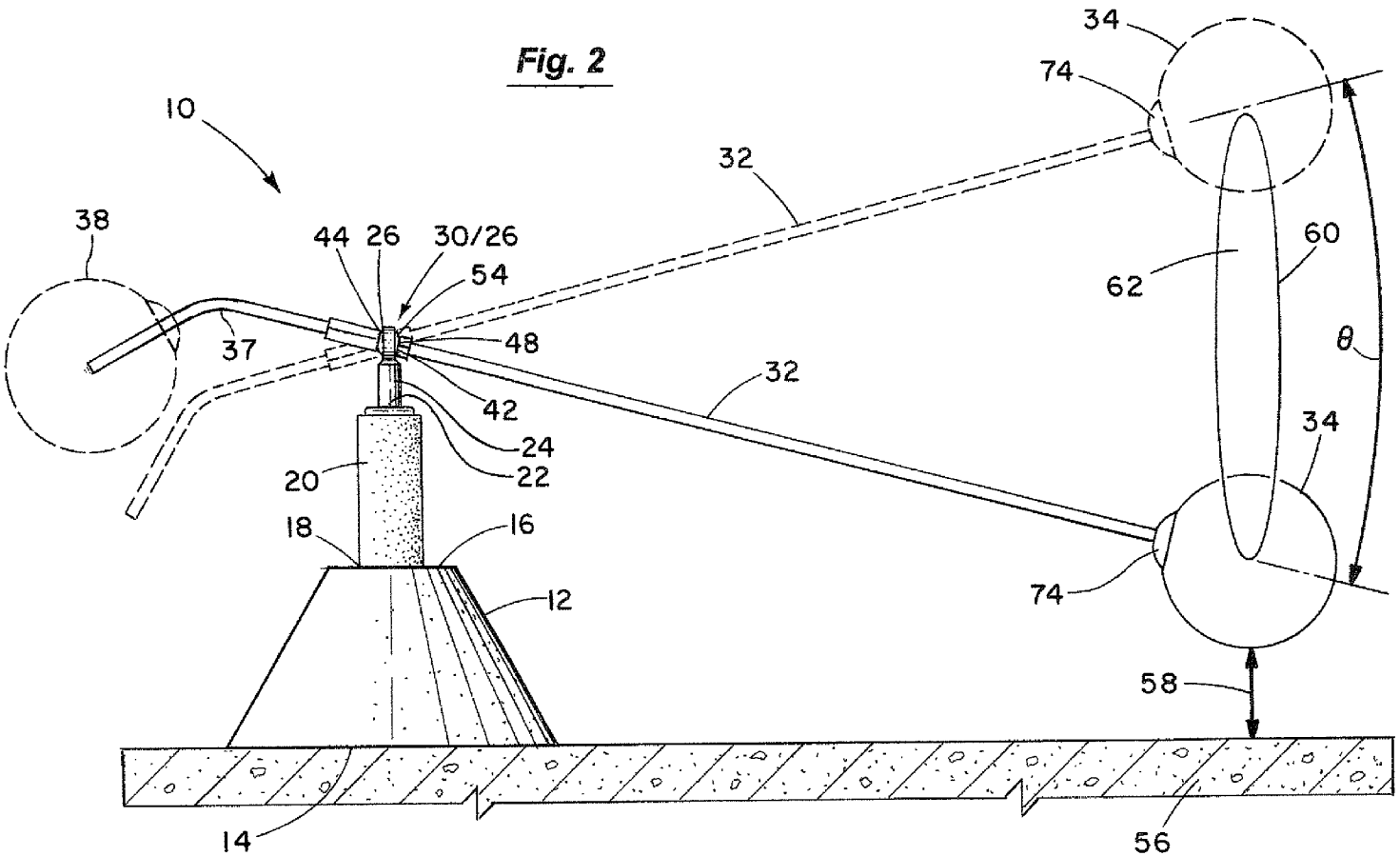
FIG. 2 is a side view of a kicking-training apparatus that depicts the use of a second ball.

FIG. 2 is a side view of the apparatus 10 shown in FIG. 1. This view shows the ball 34 attached to an outer end of the arm 32 and having a vertical arc range of motion $\ominus$. This vertical arc range of motion is defined by the fact that the bottom surface 40 of a forward nut 48 (see FIG. 4) will collide with the bottom surface 42 of the socket opening 44 when the ball 34 is at its lowest position on the arc $\ominus$. That is to say that the bottom surface 40 of the forward nut 48, that is attached to a forward threaded end 50 of the inner end of the arm 32, will collide with the bottom surface 42 of the socket opening 44 and thereby define the lower limit of the angle ⊖. Conversely, (again see FIG. 4) the top surface 52 of the forward threaded nut 48 will collide with the top surface 54 of the socket opening 44 when the kicking ball 34 is at its highest position on the arc ⊖ (as depicted by the phantom line presentation of the arm 32 in FIG. 2).

The bottom of the arc range of motion ⊖ is such that the ball 34 is held above the ground 56 by a distance 58. It should also be appreciated that Applicant's ball and socket device 30/26 will both define a generally circular range of motion 60 of the ball 34 and create a generally circular region 62 that lies within the limiting circular range of motion 60. Neglecting the lateral motion 35 of the ball 34 shown in FIG. 1, these limiting generally circular ranges of motion 60 and 62 will serve to define the vertical location of the ball at any given time. FIG. 2 also shows an alternative embodiment of this invention wherein the counterweight arm 37 is provided with a second ball 38 depicted in phantom lines. This second kicking ball 38 need not be the same size as the first kicking ball 34.

Figure 3:
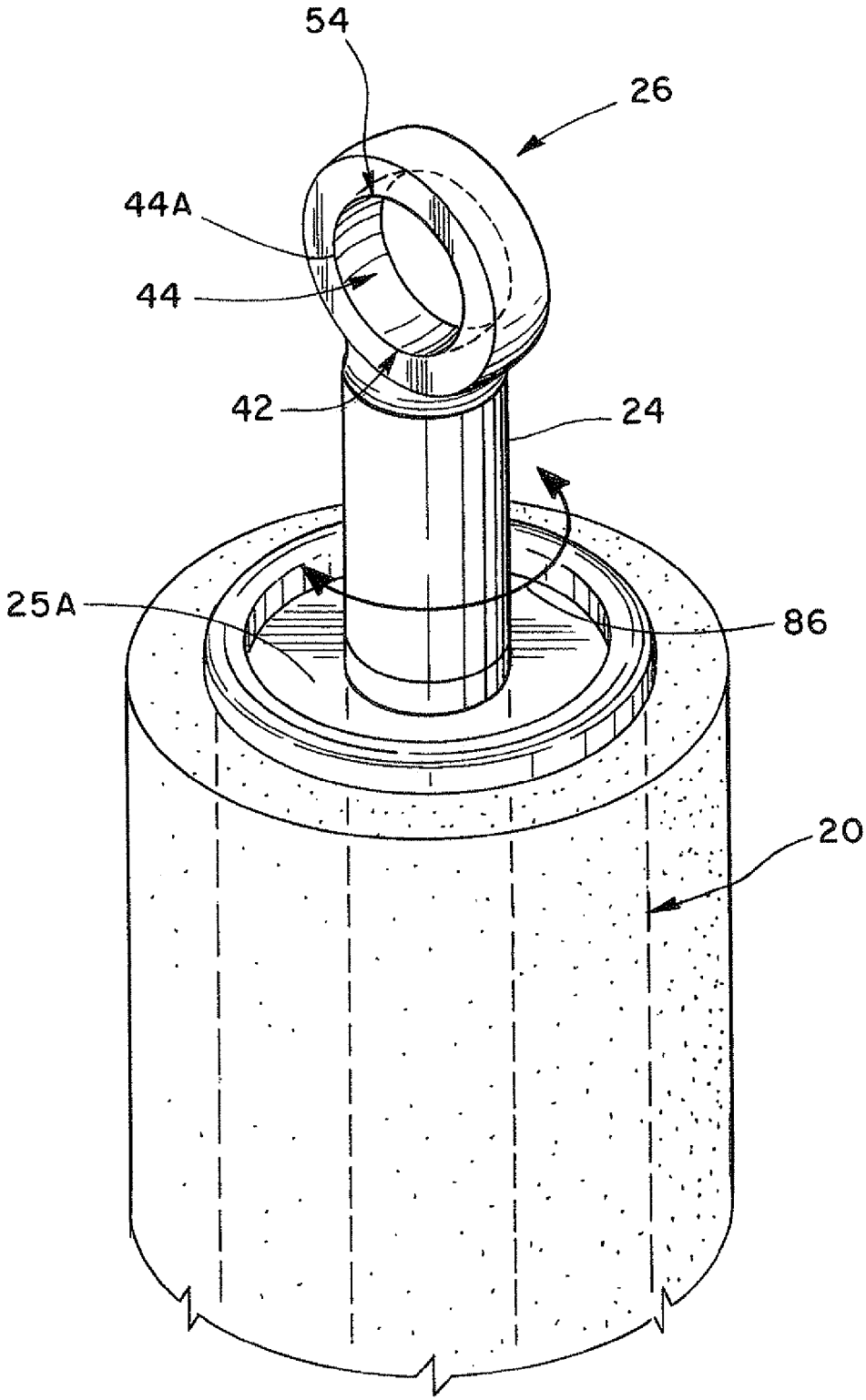
FIG. 3 is an enlarged perspective view of the socket component of the apparatus.

FIG. 3 is an enlarged perspective view of the socket 26 of the ball and socket device 30/26. For the sake of clarity, the ball component 30 of said ball and socket device 30/26 is not shown in FIG. 3. In any case, the socket 26 has an opening 44 in which the ball component 30 is rotatably mounted in ball and socket joint fashion. The bottom surface 42 of the socket opening 44 and the top surface 54 of said opening 44 will collide with the arm 32 in the first embodiment of this invention wherein the arm passes through the opening 30A in the ball component 30 of the ball and socket joint 30/26. In the second embodiment, the bottom surface 42 of the socket opening 44 and the top surface 54 of the opening 44 will collide with the forward nut 48 in a manner that will be further discussed with respect to FIG. 4. Indeed, the outside surface of the arm 32 or the forward nut 48 can collide with the entire circumference 44A of the socket opening 44 and thereby defining the limiting circular range of motion 60 previously discussed with respect to FIG. 2. Thus, the user of Applicant's ball kicking-training apparatus 10 gains practice in dealing with a ball 34 that will be located anywhere in the region 62 depicted in FIG. 2. FIG. 3 also shows the axle 24 affixed to a top roller bearing 25A.

Figure 4:
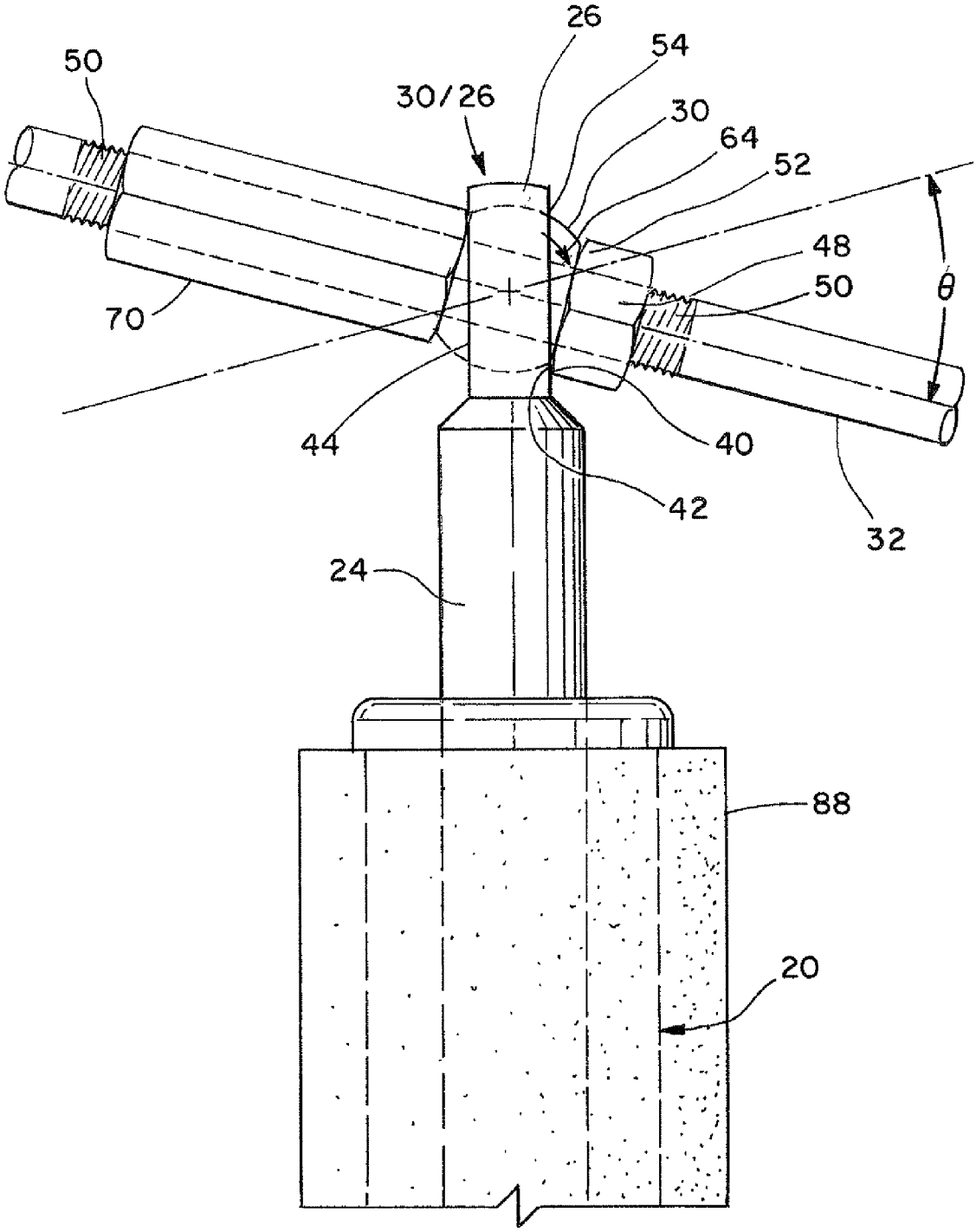
FIG. 4 is a side view of the ball and socket joint showing how the lower limit of its range of motion is defined.

FIG. 4 is a side view of the ball and socket device 30/26 being used according to the second embodiment of this invention (which employs a forward threaded nut 48 and a rearward threaded nut 70) and having reached its lowest position with respect to its arc range of motion ⊖. That is to say that bail 30 of the ball and socket device 30/26 has rotated in a clockwise direction 64 in socket 26 to such an extent that the bottom surface 40 of the forward threaded nut 48, which is threadedly attached to a threaded portion 50 of the arm 32 (see FIGS. 5 and 6), collides with the bottom surface 42 of the rim 44A of the opening 44 in the socket 26. If arm 32 were rotated to the top of the arc ⊖, the upper surface 52 of the forward threaded nut 48 would collide with the upper edge 54 of the opening 44 in the socket 26.

Figure 5:
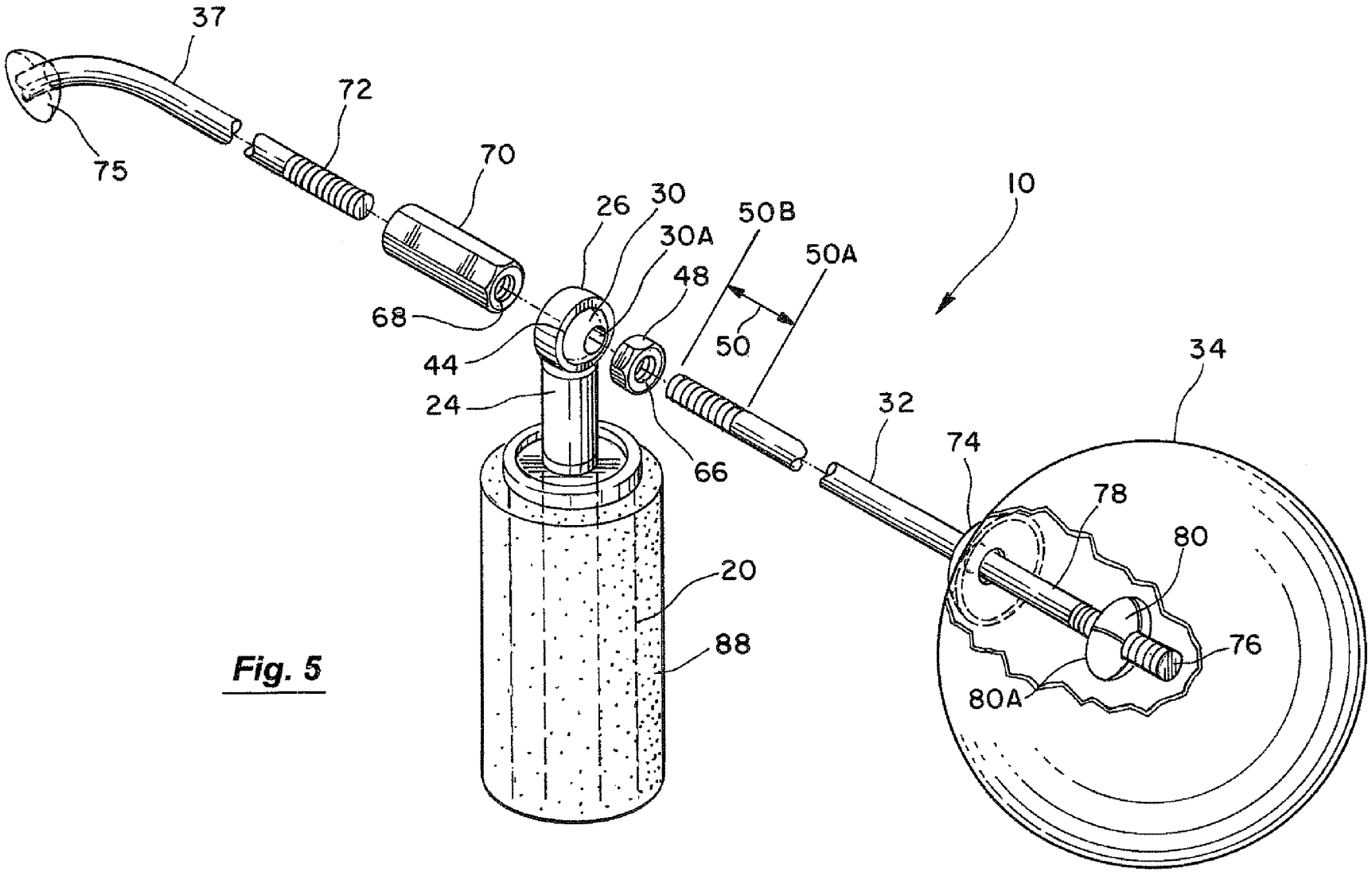
FIG. 5 is an exploded view of various components of the second embodiment of this apparatus.

FIG. 5 is an exploded view of various components of the apparatus 10 shown in FIGS. 1 and 2 of this patent disclosure. Again, this is the second embodiment of this invention wherein a forward threaded nut 48 and a rearward threaded nut 70 are used to affix the arm 32 to the ball and socket device 30/26. In this exploded view, the arm 32 is shown provided with a forward end 50 that is threaded. This forward threaded end 50 has a front end 50A and a rear end 50B. The forward threaded nut 48 has a threaded hole 66 for mounting said nut 48 on the front end 50A of the arm 32. The rear end 50B of the threaded end 50 is then passed through a hole 30A in the ball 30 of the ball and socket device 30/26. The threaded rear end 50B of the forward threaded end 50 extends beyond the ball 30 and socket 26 far enough that the threaded rear end 50B can threadedly engaged with a threaded hole 68 of an extended rearward threaded nut 70. Thus, the arm 32 can be affixed to the ball portion 30 of the ball and socket 30/26 device by threading the rearward extended threaded nut 70 inwardly to compress the respective sides of the ball component 30 between the forward threaded nut 48 and the rearward extended threaded nut 70. By this means the arm 32 is affixed to the ball component 30 while said ball component is free to rotate in the socket opening 44 up to an extent that the outside surface of the forward nut 48 will impact upon the circumference 44A of the socket opening 44 as indicated in FIGS. 3 and 4. A threaded end 72 of the counterweight arm 37 can be threadedly engaged with the opposite end of the threaded hole 68 in the rearward threaded nut 70. The opposite end of the counterweight arm 37 may be provided with a device 75 for attaching a counterweight and/or a second ball 38 (and especially a solid foam kicking ball) to the counterweight arm 37.

FIG. 5 also shows a particularly effective method whereby a kicking ball 34 may be affixed to the arm 32. First, an outside cup 74 (e.g., a suction cup) is slid up the arm 32 a distance sufficient to allow a threaded end 76 of the arm 32 to penetrate into an extended (e.g., to the center of the ball 34) hole 78 in the ball 34. Before the threaded end 76 is inserted into the hole 78 it is provided with an inside cup 80 whose rim 80A faces toward the outside cup 74 when said inside cup 80A is forced into the hole 78 in the bail 34. Glue may be inserted into hole 78 and on to the inside cup 80 as well. Thus, the rim 80A of the inside cup 80 serves as a "hook" that prevents the inside cup 80, and hence the arm 32 that is affixed to it, from being pulled out of the hole 78 in the ball 34. Thereafter, the outside cup 74 (preferably a suction cup) is affixed to the outside surface of the ball 34. Here again, a glue may be employed in helping to affix the outside cup 74 to the outside surface of the ball 34.

Figure 6:
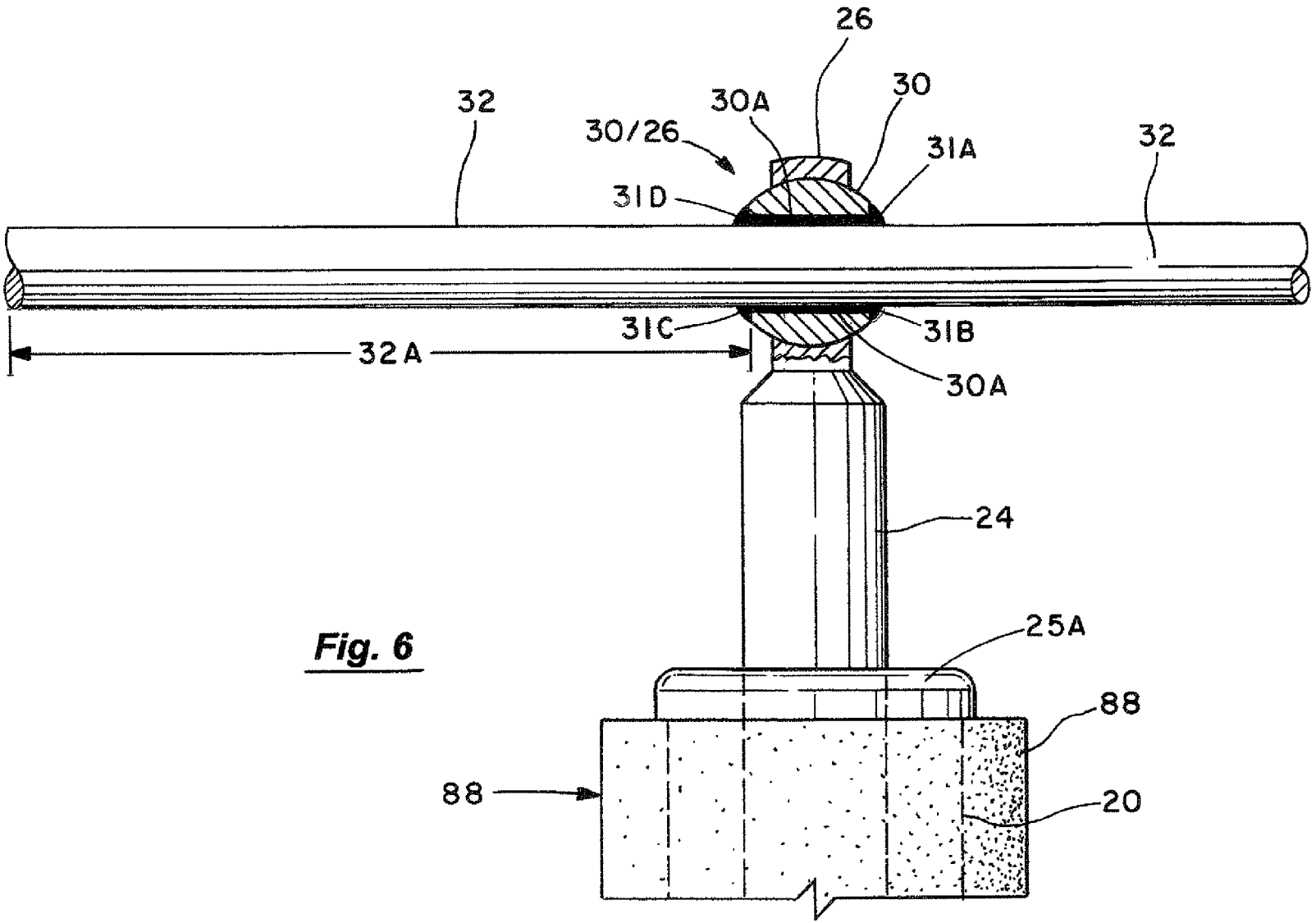
FIG. 6 is a cut-away side view of an assembled ball and socket joint constructed according to the first embodiment of this invention wherein the inner end of the arm extends through and projects beyond the hole in the ball component of the ball and socket joint.

FIG. 6 shows the first embodiment of this invention wherein the ball and socket device 30/26 is assembled with an arm 32 whose outer end supports the kicking ball 34 (not shown) and whose inner end passes through and projects from the hole 30A in the ball portion 30 of the ball and socket device 30/26. This view is intended to suggest that the arm 32 can be, in effect, compression fitted into the hole 30A in the ball 30. The arm can be glued into the hole 30A as well. In any case, the projecting portion of the arm 32 is designated 32A. This projecting portion will have a straight configuration. A second ball such as the second ball 38 depicted in FIG. 2 can be affixed to this straight projecting portion 37 of arm 32. Again, this figure also shows how the compression fitted arm 32 can be further affixed in the hole 30A by means of dollops of glue 31A, 31B, 31C and 31D applied at the intersection of the arm 32 and the right side of the ball 30 as well as the intersection of the arm 32 and the left side of the ball 30. The presence of such glue inside the hole 30A is exaggerated for purposes of visual clarity. Other devices (e.g., cotter keys, spring loaded clips and the like) can be used to affix the arm 32 in the hole in the ball 30 of the ball and socket device 30/26.

Figure 6A:
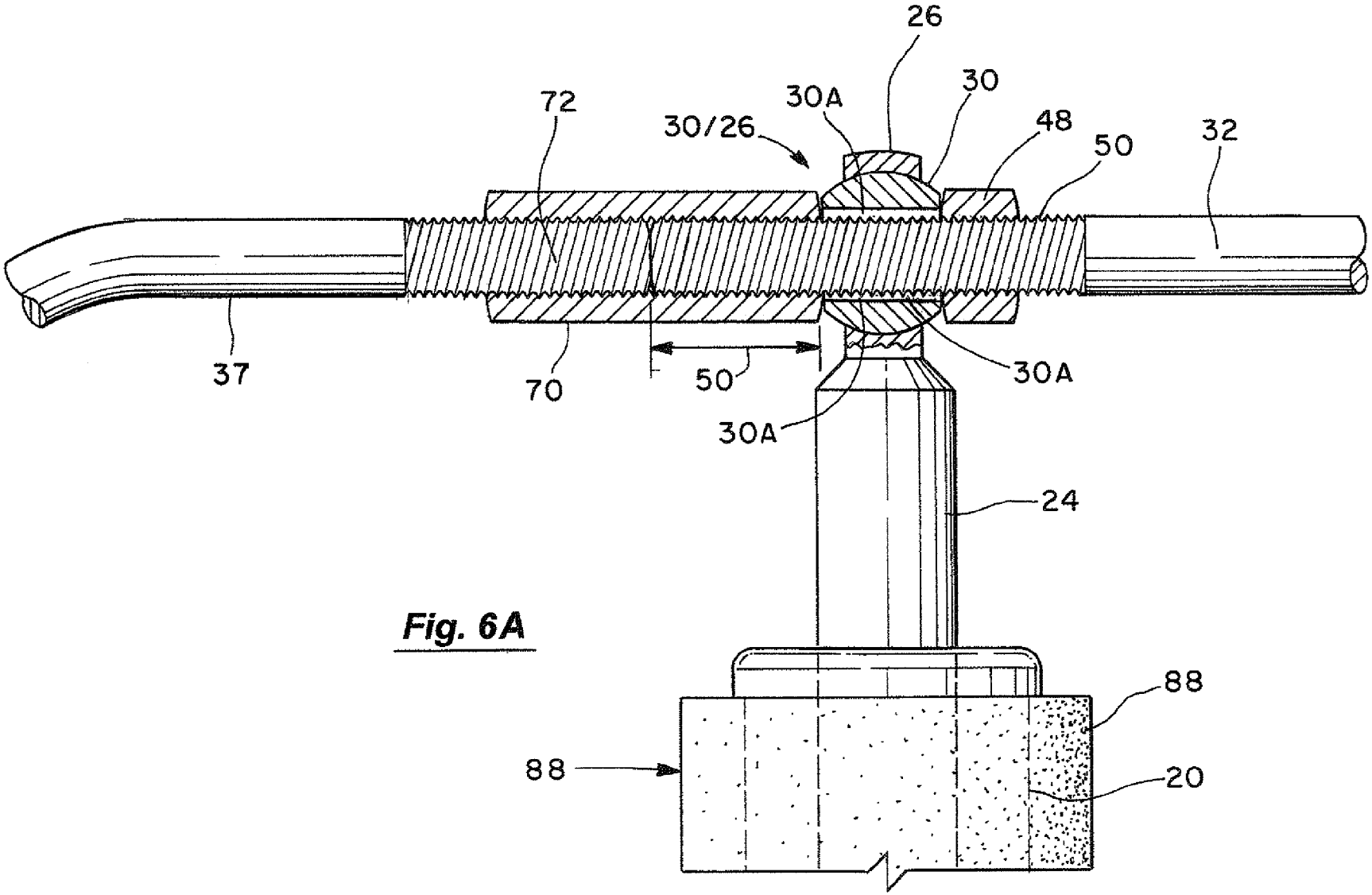
FIG. 6A is a cut-away side view of an assembled ball and socket joint made according to the second embodiment of this invention wherein the inner end of the arm is threaded to receive a forward threaded nut and a rearward threaded nut.

FIG. 6A also shows the ball and socket device 30/26 assembled with an arm 32 whose outer end supports a kicking ball 34 (not shown) and whose inner end 50 passes through the hole 30A in the ball portion 30 of the ball and socket device 30/26. This view also shows how the ball 30 of the ball and socket joint 30/26 is, in effect, compressed between the forward threaded nut 48 and the extended threaded nut 70 by virtue of their being respectively threaded on to the threaded end 50 of the arm 32 in the manner shown.

Figure 7:
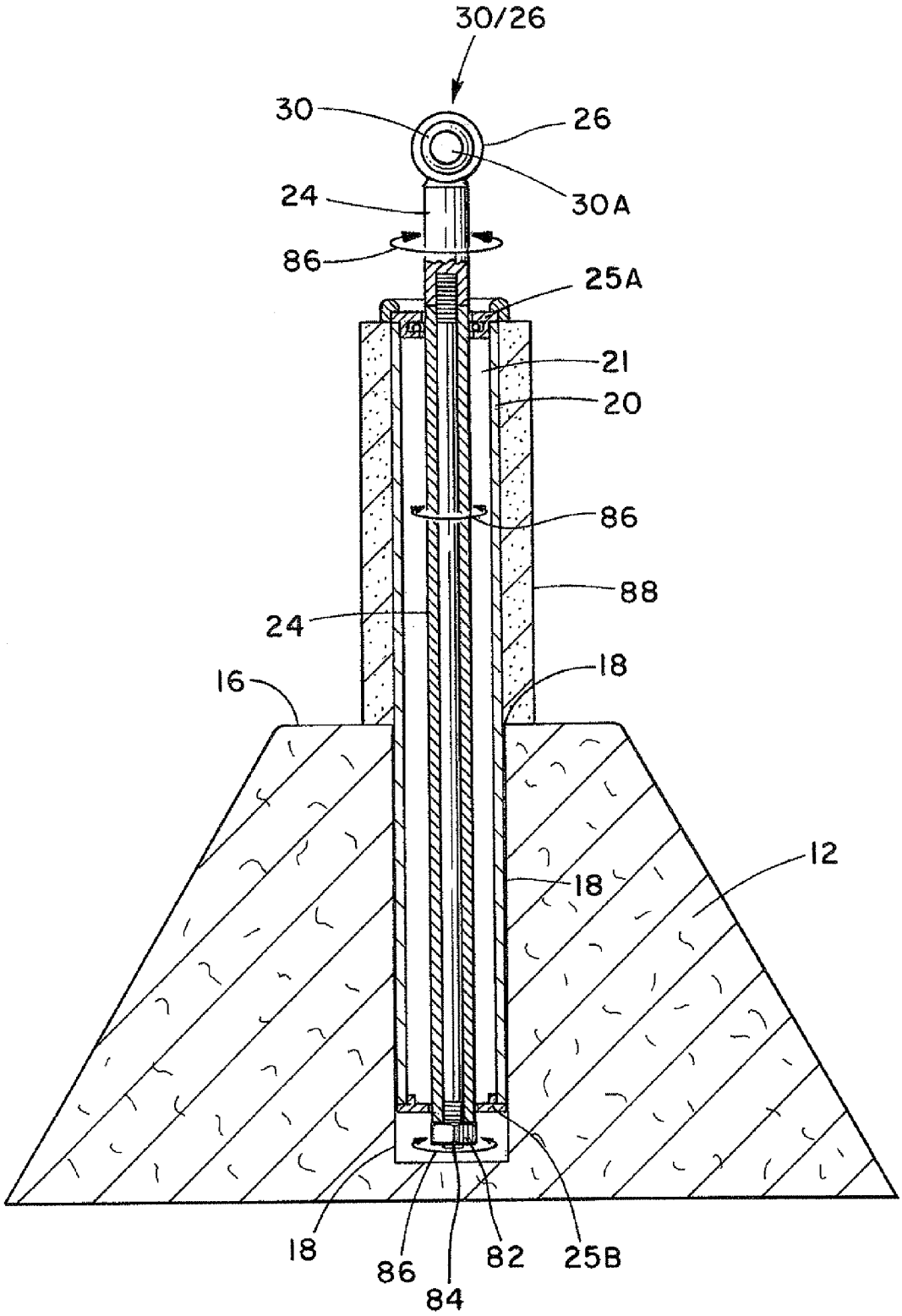
FIG. 7 is a cut-away view of the ball and socket joint and the post in which the axle of said ball and socket joint is mounted.

FIG. 7 is a cut-away view of the ball and socket device 30/26 of this patent disclosure shown vertically mounted in the cylindrical cavity 18 of the base 12. Viewing this ball and socket device 30/26 from top to bottom, one notes the socket 26 houses the rotatable ball 30 in a ball and socket fashion. The rotatable ball 30 has a hole 30A for receiving the inner end of the arm 32 (not shown). The ball and socket device 30/26 is rigidly affixed on top of an axle 24 that extends through the post 20. The axle 24 can, for example, be made rotatable by virtue of being mounted to a top roller bearing 25A and a bottom roller bearing 25B. The post 20 is snuggly fitted into the cavity 18 in the base 12. The post 20 also has a hole 21 in which the rotatable axle 24 is housed. The lower end 84 of the axle 24 can be threaded and a threaded nut 82 is shown attached to said axle 24 at its threaded lower end 84. The axle 24 is completely free to rotate in the post in either direction as suggested by two-headed arrow 86. The lower end of the post 20 is shown residing in the cavity 18 of the base 12. The upper portion of the post 20 that extends above the top 16 of the base 12 is shown surrounded by a sleeve 88 of a compliant material such as a polymer foam. This sleeve 88 serves as a safety cover for this part of the post 20.

The above patent disclosure sets forth a number of embodiments of the present invention that are described in detail herein, especially with respect to the accompanying drawings. Those skilled in this art will however further appreciate that various changes, modifications, other structural arrangements, and other method oriented embodiments could be practiced under the teachings of the present invention without departing from its scope as set forth in the following claims.

I claim:

1. A ball kicking training apparatus comprising:

(1) a base having a flat bottom and a cavity for receiving a post;

(2) a post capable of being snuggly fitted into the cavity in the base such that said post is held in a vertical orientation and wherein the post is further provided with a hole in which a rotatable axle is mounted;

(3) a rotatable axle having a lower portion that is rotatably mounted in the hole in the post and an upper portion that terminates in a socket that is sized, adapted and arranged to receive a ball component and thereby creating a ball and socket joint;

(4) an arm whose inner end passes through a hole in the ball component of the ball and socket joint and wherein said arm has an outer end that is attached to a ball to be kicked by a user of this ball kicking training apparatus; and (5) a ball attached to the outer end of the arm.

2. The ball kicking training apparatus of claim 1 wherein the inner end of the arm extends through and projects beyond the hole in the ball component of the ball and socket joint.

3. The ball kicking training apparatus of claim 1 wherein the inner end of the arm extends through the hole in the ball component of the ball and socket joint and wherein the arm is glued to said ball component.

4. The ball kicking training apparatus of claim 1 wherein the inner end of the arm extends through and projects beyond the hole in the ball component of the ball and socket joint and wherein said inner end of the arm is attached to a second ball.

5. A ball kicking training apparatus comprising:

(1) a base having a flat bottom and a cavity for receiving a post;

(2) a post capable of being snuggly fitted into the cavity in the base such that said post is held in a vertical orientation and wherein the post is further provided with a hole in which a rotatable axle is housed;

(3) a rotatable axle having a lower portion that is rotatably mounted in the hole in the post and an upper portion that terminates in a socket that is sized, adapted and arranged to receive a ball component and thereby creating a ball and socket joint;

(4) an arm having an inner end capable of passing through a hole in the ball component of the ball and socket joint and wherein said inner end of the arm has a threaded portion to receive a forward threaded nut and a rearward threaded nut and wherein said arm has an outer end that is attached to a ball to be kicked by a user of this ball kicking training apparatus;

(5) a forward threaded nut that is threaded on to the threaded portion of the inner end of the arm and threaded into abutment with a forward side of the ball component of the ball and socket joint;

(6) a rearward threaded nut that is threaded on to the threaded portion of the inner end of the arm and threaded into abutment with a rearward side of the ball component of the ball and socket joint; and (7) a ball attached to the outer end of the arm.

6. The ball kicking training apparatus of claim 5 further comprising a counterweight arm threadedly attached to the rearward threaded nut.

7. The ball kicking training apparatus of claim 5 further comprising a counterweight arm threadedly attached to the rearward threaded nut and wherein said counterweight arm is attached to a second kicking ball.

8. The ball kicking training apparatus of claim 5 wherein the ball attached to the outer end of the arm is a solid sphere of a foamed polymer material.

9. The ball kicking training apparatus of claim 5 wherein the ball attached to the outer end of the arm is a solid sphere of a foamed polymer material that is attached to said outer end of the arm by means of a flexible cup that is attached to the outer end of the arm located in a hole in the solid sphere of the foamed polymer material.

10. The ball kicking training apparatus of claim 5 wherein the ball attached to the outer end of the arm is a ball that simulates the size and visual appearance of a soccer ball.

11. The ball kicking training apparatus of claim 5 wherein an upper region of the post is provided with a protective cover.

12. A ball kicking training apparatus comprising:

(1) a base having a flat bottom and a cavity for receiving a post;

(2) a post capable of being snuggly fitted into the cavity in the base such that said post is held in a vertical orientation and wherein the post is further provided with a hole in which a rotatable axle is mounted;

(3) a rotatable axle having a lower portion that is rotatably mounted in the hole in the post and an upper portion that terminates in a socket that is sized, adapted and arranged to receive a ball component and thereby creating a ball and socket joint;

(4) an arm having an inner end capable of passing through a hole in the ball component of the ball and socket joint and wherein said inner end of the arm has a threaded portion to receive a forward threaded nut and a rearward threaded nut and wherein said arm has an outer end that is attached to a ball to be kicked by a user of this ball kicking training apparatus;

(5) a forward threaded nut that is threaded on to the threaded portion of the inner end of the arm and threaded into abutment with a forward side of the ball component of the ball and socket joint;

(6) a rearward threaded nut that is threaded on to the threaded portion of the inner end of the arm and threaded into abutment with a rearward side of the ball component of the ball and socket joint;

(7) a counterweight arm that is threaded on to the rearward threaded nut; and (8) a ball attached to the outer end of the arm.

13. The ball kicking training apparatus of claim 12 further comprising a counterweight arm that is attached to a second kicking ball.

14. The ball kicking training apparatus of claim 12 wherein the ball attached to the outer end of the arm is a solid sphere of a foamed polymer material.

15. The ball kicking training apparatus of claim 12 wherein the ball attached to the outer end of the arm is a solid sphere of a foamed polymer material that is attached to said outer end of the arm by means of a flexible cup that is attached to the outer end of the arm and located in a hole in the solid sphere of the foamed polymer material.

16. The ball kicking training apparatus of claim 12 wherein the ball attached to the outer end of the arm is a ball that simulates the size and visual appearance of a regulation sized soccer ball.

17. The ball kicking training apparatus of claim 12 wherein an upper region of the post is provided with a protective cover.

18. A ball kicking training apparatus comprising:

(1) a base having a truncated conical configuration, a flat bottom and a circular cavity for receiving a circular post;

(2) a circular post snuggly fitted into the circular cavity in the base such that said post is held in a vertical orientation and wherein the post is further provided with a hole in which a rotatable axle is housed;

(3) a rotatable axle having a lower portion that is rotatably mounted in the hole in the post and an upper portion that terminates in a socket that is sized, adapted and arranged to receive a ball component and thereby creating a ball and socket joint;

(4) an arm having an inner end capable of passing through a hole in the ball component of the ball and socket joint and wherein said inner end of the arm has a threaded portion to receive a forward threaded nut and a rearward threaded nut and wherein said arm has an outer end that is attached to a ball to be kicked by a user of this ball kicking training apparatus;

(5) a forward threaded nut that is threaded on to the threaded portion of the inner end of the arm and threaded into abutment with a forward side of the ball component of the ball and socket joint;

(6) a rearward threaded nut that is threaded on to the threaded portion of the inner end of the arm and threaded into abutment with a rearward side of the ball component of the ball and socket joint;

(7) a counterweight arm threadedly attached to the rearward threaded nut and wherein said counterweight arm is attached to a second kicking ball; and (8) a ball attached to the outer end of the arm.

19. The ball kicking training apparatus of claim 18 wherein the ball attached to the outer end of the arm is a solid sphere of a foamed polymer material.

20. The ball kicking training apparatus of claim 18 wherein the ball attached to the outer end of the arm is a solid sphere of a foamed polymer material that is attached to said outer end of the arm by means of a flexible cup that is attached to the outer end of the arm and located in a hole in the solid sphere of the foamed polymer material.

21. The ball kicking training apparatus of claim 18 wherein the ball attached to the outer end of the arm is a ball that simulates the size and visual appearance of a soccer ball.

22. The ball kicking training apparatus of claim 18 wherein an upper region of the post is provided with a protective cover.

23. A method of mounting an arm of a ball kicking training apparatus having a base, a post that is vertically mounted in said base, an arm whose inner end is rotatably mounted to the post and a ball that is attached to an outer end of the arm wherein said method comprises mounting the inner end of the arm within a hole in a ball component of a ball and socket joint that is affixed to the top end of an axle that is rotatably mounted in the post.

* * * * *